US007823926B2

(12) United States Patent
Richied et al.

(10) Patent No.: US 7,823,926 B2
(45) Date of Patent: Nov. 2, 2010

(54) DUAL NOTEBOOK

(75) Inventors: Kenneth P. Richied, Liberty Township, OH (US); Maureen M. Rieder, Liberty Township, OH (US); Amy N. Botkin, Dayton, OH (US)

(73) Assignee: MeadWestvaco Corporation, Richmond, VA (US)

( * ) Notice: Subject to any disclaimer, the term of this patent is extended or adjusted under 35 U.S.C. 154(b) by 664 days.

(21) Appl. No.: 11/194,330

(22) Filed: Aug. 1, 2005

(65) Prior Publication Data

US 2007/0024047 A1 Feb. 1, 2007

(51) Int. Cl.
*B42D 1/00* (2006.01)
*B42D 3/18* (2006.01)

(52) U.S. Cl. ..... 281/21.1; 281/29

(58) Field of Classification Search ..... 281/3.1, 281/15.1, 16, 17, 21.1, 27.1, 27.2, 29, 33, 281/40; 402/57, 70, 73, 80 R, 502; 283/2–4, 283/36, 42, 43
See application file for complete search history.

(56) References Cited

U.S. PATENT DOCUMENTS

| | | | | |
|---|---|---|---|---|
| 432,700 | A | 7/1890 | Gregg | |
| 1,121,197 | A | 12/1914 | McMillan | |
| 1,460,426 | A | 7/1923 | McSheehy | |
| 2,050,545 | A * | 8/1936 | Schade | 281/29 |
| 2,317,673 | A | 4/1943 | Craig | |
| 2,486,840 | A | 11/1949 | Harris | |
| 3,227,471 | A | 1/1966 | Coniker | |
| 3,479,752 | A | 11/1969 | Criger | |
| 3,565,462 | A | 2/1971 | Gottlieb | |
| 3,620,552 | A | 11/1971 | Woodcock et al. | |
| 3,758,136 | A | 9/1973 | Guyer | |
| 3,837,680 | A | 9/1974 | Cimini | |
| 3,870,223 | A | 3/1975 | Wyant | |
| 4,519,629 | A | 5/1985 | Podosek | |
| 4,620,725 | A | 11/1986 | Maehashi | |
| 4,947,564 | A | 8/1990 | Reece et al. | |
| 5,174,674 | A * | 12/1992 | Norwood | 402/73 |
| 5,215,398 | A | 6/1993 | White et al. | |
| 5,284,242 | A | 2/1994 | Roth et al. | |
| 5,674,021 | A | 10/1997 | Hutnick | |
| 5,676,482 | A | 10/1997 | Hawkins | |
| 5,725,196 | A | 3/1998 | Scheel | |
| 5,836,614 | A | 11/1998 | Park | |
| 6,210,065 | B1 | 4/2001 | Tower | |
| 6,267,413 | B1 | 7/2001 | Tran | |
| 6,379,070 | B1 | 4/2002 | Butchma | |
| 6,702,331 | B2 | 3/2004 | Derraugh et al. | |
| 6,712,396 | B2 * | 3/2004 | Derraugh | 281/38 |
| 2003/0210948 | A1 | 11/2003 | James, Jr. | |

* cited by examiner

*Primary Examiner*—Dana Ross
*Assistant Examiner*—Pradeep C Battula
(74) *Attorney, Agent, or Firm*—MWV Intellectual Property Group

(57) ABSTRACT

A dual notebook including a sheet of backing material, a first set of papers bound to the backing material and having a thickness, and a second set of papers bound to the backing material and having a thickness. The backing material is configured to be folded into a folded position wherein the folded backing material is positioned between the first and second set of papers in a thickness direction of the notebook. The backing material is movable to a flat position wherein the backing material is generally flat, and wherein when the backing material is in the flat position the first and second sets of papers are spaced apart by a distance less than the combined thickness of the first and second sets of papers.

19 Claims, 8 Drawing Sheets

DUAL NOTEBOOK

The present invention is directed to notebook having two sets of bound sheets, and more particularly, to such a notebook which can be moved to a compact position.

BACKGROUND

Notebooks are widely used by students, professionals, homemakers and the like for making notes, memoranda, etc. Most existing notebooks include a single set of papers bound together by a binding mechanism. However, such a notebook is restricted in its use and configuration. In particular, only the single set of papers may be able to be accessed and manipulated, and it may be difficult to segregate two different types of information in the single notebook. Accordingly, there is a need for a notebook with two separate sets of bound papers.

SUMMARY

In one embodiment the invention is a dual notebook having first and second sets of bound papers. In particular, in one embodiment the invention is a dual notebook including a sheet of backing material, a first set of papers bound to the backing material and having a thickness, and a second set of papers bound to the backing material and having a thickness. The backing material is configured to be folded into a folded position wherein the folded backing material is positioned between the first and second set of papers in a thickness direction of the notebook. The backing material is movable to a flat position wherein the backing material is generally flat, and wherein when the backing material is in the flat position the first and second sets of papers are spaced apart by a distance less than the combined thickness of the first and second sets of papers.

DETAILED DESCRIPTION

Figure 1:
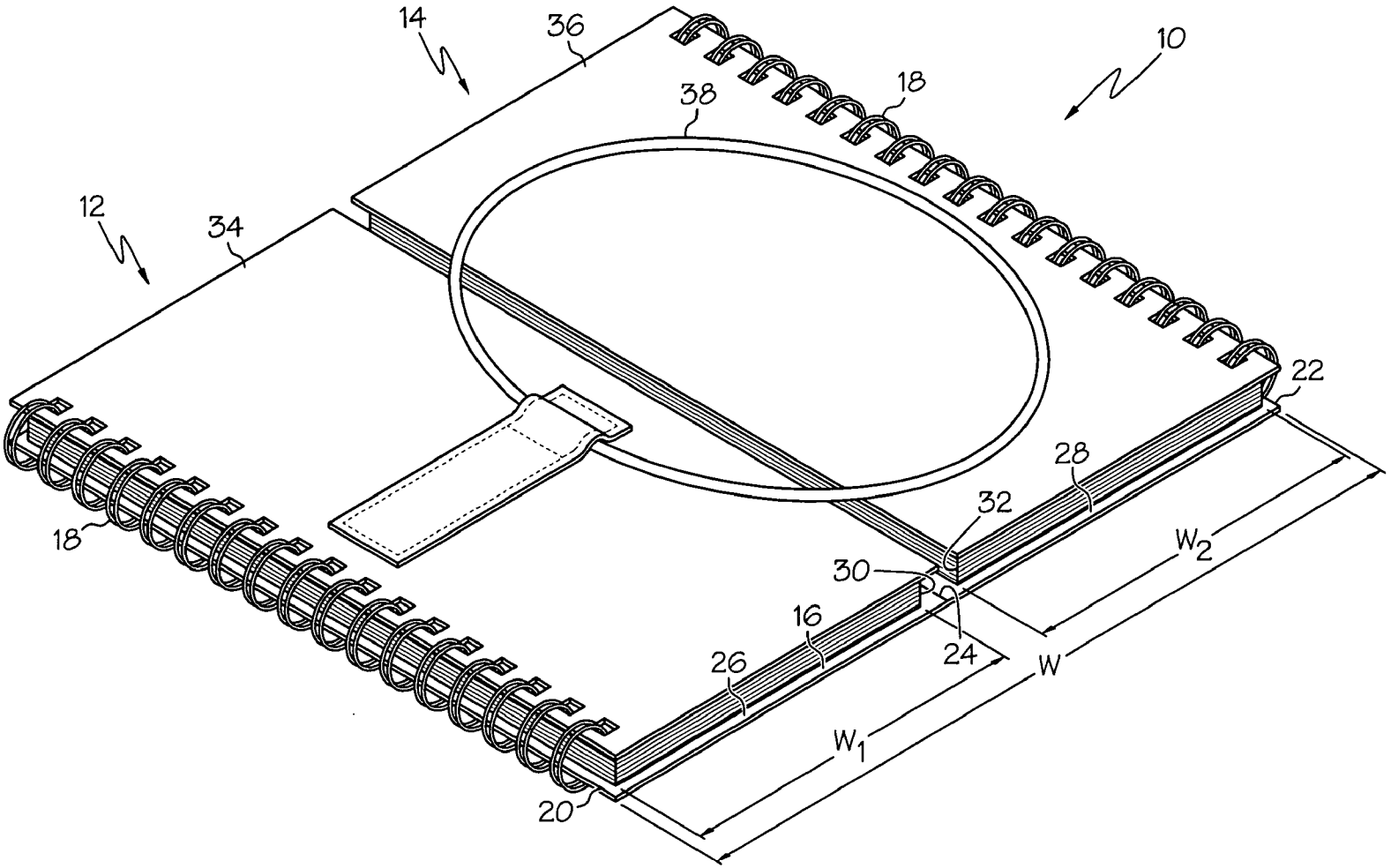
FIG. 1 is a front perspective view of one embodiment of the dual notebook of the present invention, shown in its flat position.
Figure 2:
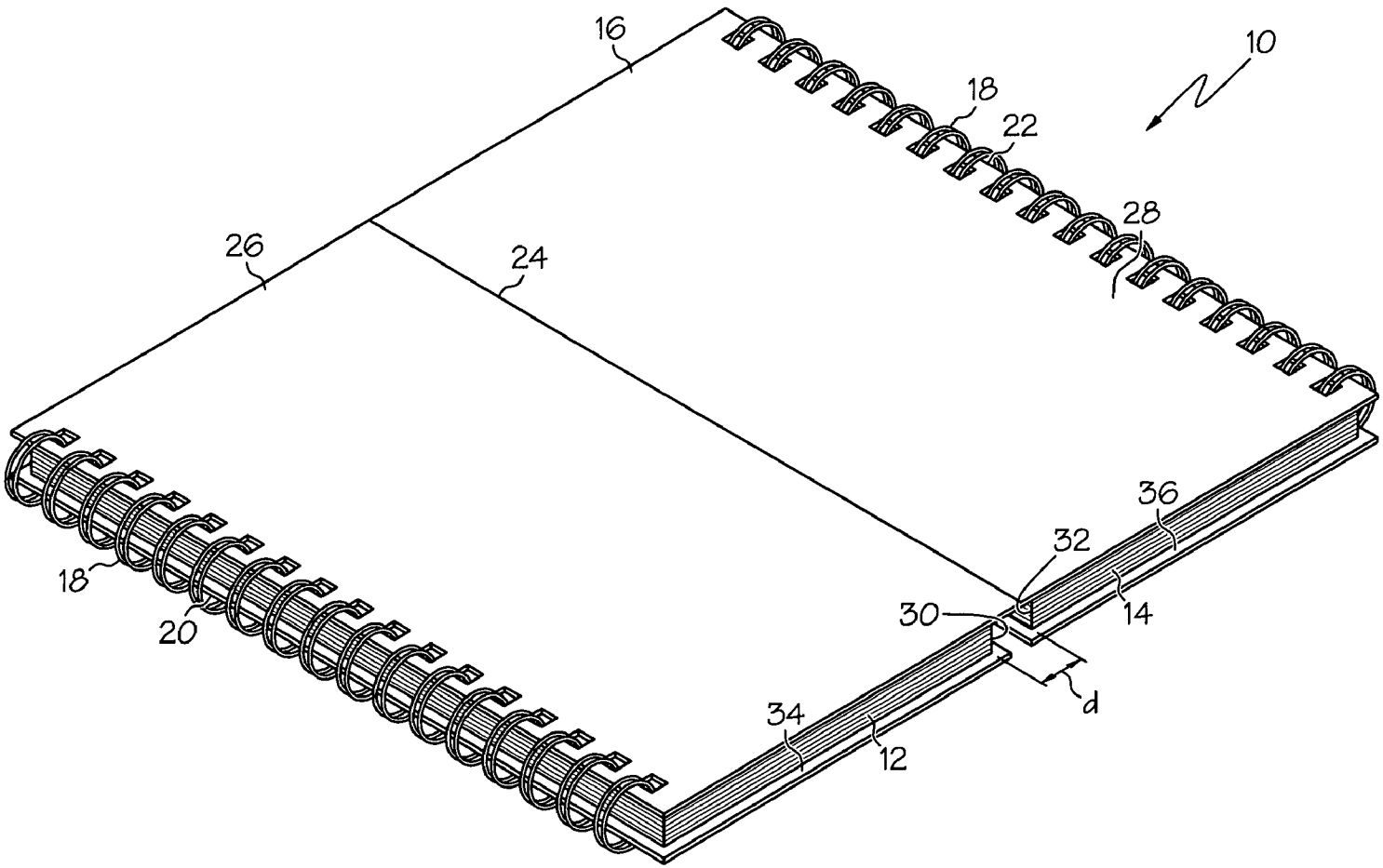
FIG. 2 is a bottom perspective view of the notebook of FIG. 1.
Figure 3:
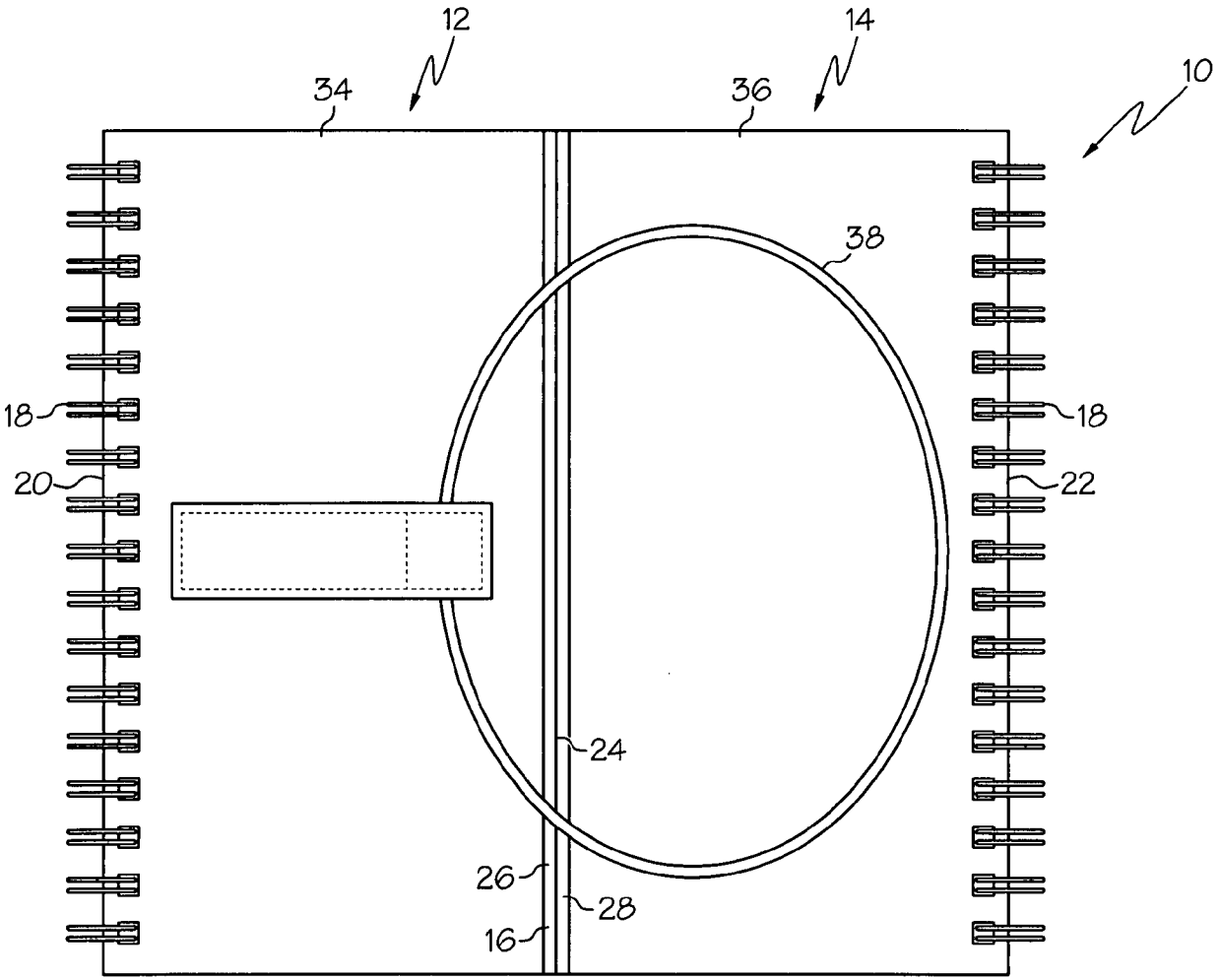
FIG. 3 is a top view of the notebook of FIG. 1.
Figure 4:
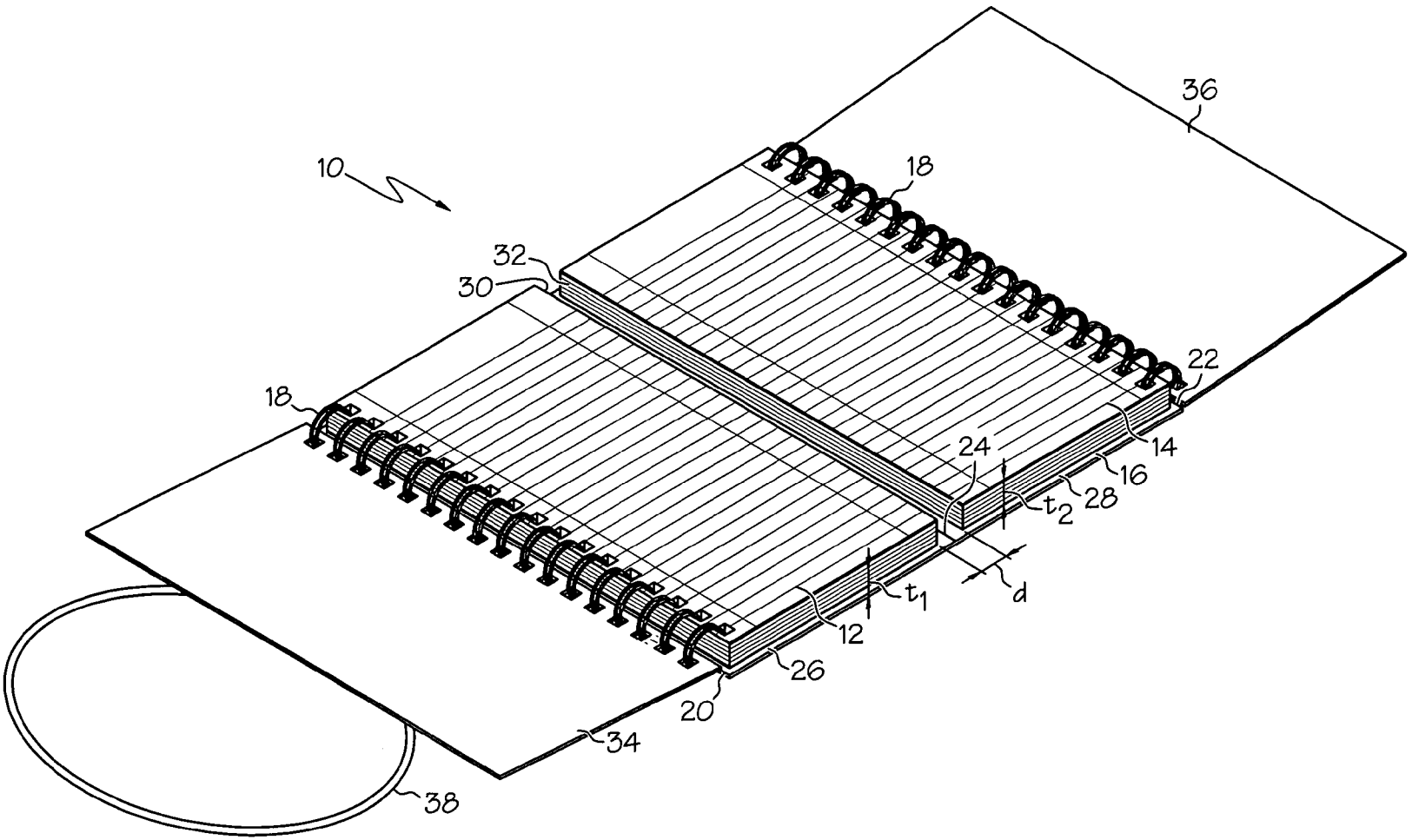
FIG. 4 is a front perspective view of the notebook of FIG. 1, with the front covers opened.
Figure 7:
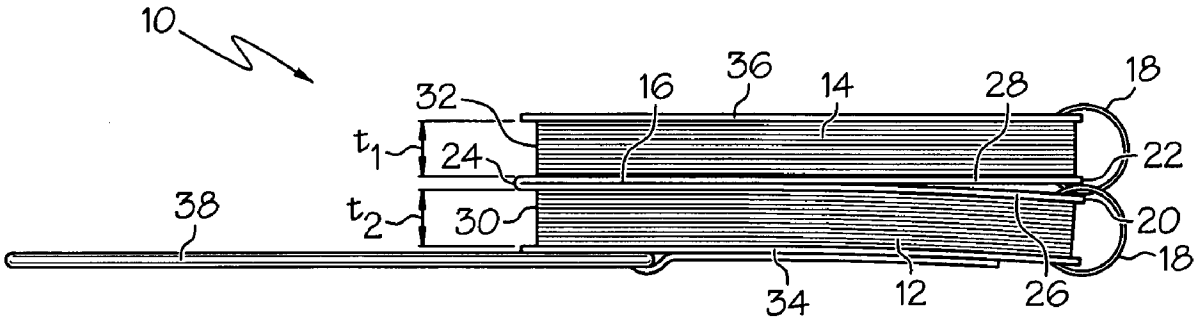
FIG. 7 is an end view of the notebook of FIG. 5.

As shown in FIG. 1, in one embodiment the dual notebook 10 of the present invention includes a first 12 and a second 14 set of papers bound to a sheet of backing material 16. Each set of papers 12, 14 may be bound to the backing material 16 by a binding mechanism 18, such as a coil binding mechanism, a spiral binding mechanism, adhesive bindings, and the like. Each set of papers 12, 14 may include a plurality of stacked papers made of cellulose based or pulp based paper or the like that can easily be written upon by a variety of marking instruments, such as pens, pencils, markers, etc. As shown in FIG. 4, each paper of the stack of papers 12, 14 may have ruled lines or the like located thereon to guide a user's writing. Each of the first and second set of papers 12, 14 may have a thickness, shown as thickness $t_1$ and $t_2$ (see FIGS. 4 and 7).

The backing material 16, as shown in its configuration in FIGS. 1-4 is preferably a generally flat, rectangular piece of material having a pair of opposed outer edges 20, 22. The backing material 16 may have a stiffness and/or flexibility greater than each sheet of the set of papers 12, 14. The backing material 16 may be made of any of a wide variety of materials, including but not limited to cardboard, plastic, paperboard or the like. In one embodiment the backing material 16 may have a folding guide line 24, such as a fold line, crease line, or area of weakness about which the backing material 16 can be folded. However, in some cases the backing material 16 may have sufficient flexibility such that the folding guide line 24 may not be necessary.

The folding guide line 24 divides the backing material 16 into a first portion 26 supporting the first set of papers 12 and a second portion 28 supporting the second set of papers 14. The first set of papers 12 is bound at or adjacent to edge 20 of the backing material 16, and the second set of papers 14 is bound by the associated binding mechanism 18 to the other edge 22. The backing material 16 has a width dimension w extending generally perpendicular to the folding guide line 24. Each set of papers 12, 14 has a width ($w_1$ and $w_2$ respectively). The combined width $w_1$ and $W_2$ of the sets of papers 12, 14 is less than the width w of the backing material 16.

The first 12 and second 14 set of papers each includes an inner edge 30, 32 located generally opposite the associated binding mechanism 18. In the configuration shown in FIGS. 1-4 (and with particular reference to FIGS. 2 and 4), the inner edges 30, 32 are generally parallel and spaced apart by a distance d (distance d can be calculated as $d=w-W_1-w_2$). In one embodiment, the distance d is less than the combined thickness $t_1$ and $t_2$, or even one of the thicknesses $t_1$ or $t_2$. It may be desired to minimize the distance d to minimize wasted space in the notebook 10. In particular, if a relatively large distance d is required to be provided between the first 12 and second 14 sets of papers, the notebook 10 would provide a larger footprint and require additional material and therefore increase costs.

Each set of papers 12, 14 may include a front cover 34, 36 located on top of each associated set of papers 12, 14 to protect the associated papers. Each cover 34, 36 can be made of a material having a thickness and/or stiffness greater than each paper of the set of papers 12, 14. For example, each cover 34, 36 may be made of cardboard, plastic, paperboard or the like.

FIG. 1 illustrates a retaining device 38, in the form of a strip of elastic material, coupled to the cover 34. The purpose of the retaining device 38 will be discussed in greater detail below. However, it should be noted that the retaining device 38 can be located at any of a variety of locations on the notebook 10, including the cover 36, on the sheet of backing material 16, on either of the binding mechanisms 18, etc.

In the configuration shown in FIG. 1, each set of papers 12, 14 can be individually accessed and written upon. For example, as shown in FIG. 4, the front covers 34, 36 can be opened to expose the sheets of papers 12, 14 underneath. Indicia, such as notes, text, memoranda, drawings, etc. may then be written onto the sheets of paper 12, 14. In addition, because the sets of papers 12, 14 are in a side-by-side orientation in FIGS. 1-4, indicia on the first set of papers 12 can be viewed at the same time as indicia on the second set of papers 14. This can be very useful in comparing notes, making cross references (i.e., condensing notes on the first set of pages 12 in an outline form on the second set of pages 14), etc.

The notebook 10 and backing material 16 are shown in their flat or unfolded position in FIGS. 1-4. The notebook 10 and backing material 16 can be moved to a folded position, as shown in FIGS. 5-8, by folding the notebook 10/backing material 16 about the folding guide line 24. In particular, the notebook 10/backing material 16 can be folded outwardly about the folding guide line 24 such that the folded backing material 16 forms a two-ply configuration wherein the folded backing material 16 is positioned between the first 12 and second 14 set of papers in the thickness direction of the notebook, as shown in FIGS. 5-8. In this position, the backing material 16 forms a generally two-ply sheet of material, with both plies 26, 28 being located between the first 12 and second 14 sets of papers in the thickness direction of the notebook 10. When in the folded position, the first 26 and second 28 portions of the backing material 16 overlap and are oriented generally parallel and immediately adjacent to each other. Moreover, as clearly seen from FIGS. 5-8, the first 26 and second 28 portions abut substantially all of one another.

Figure 6:
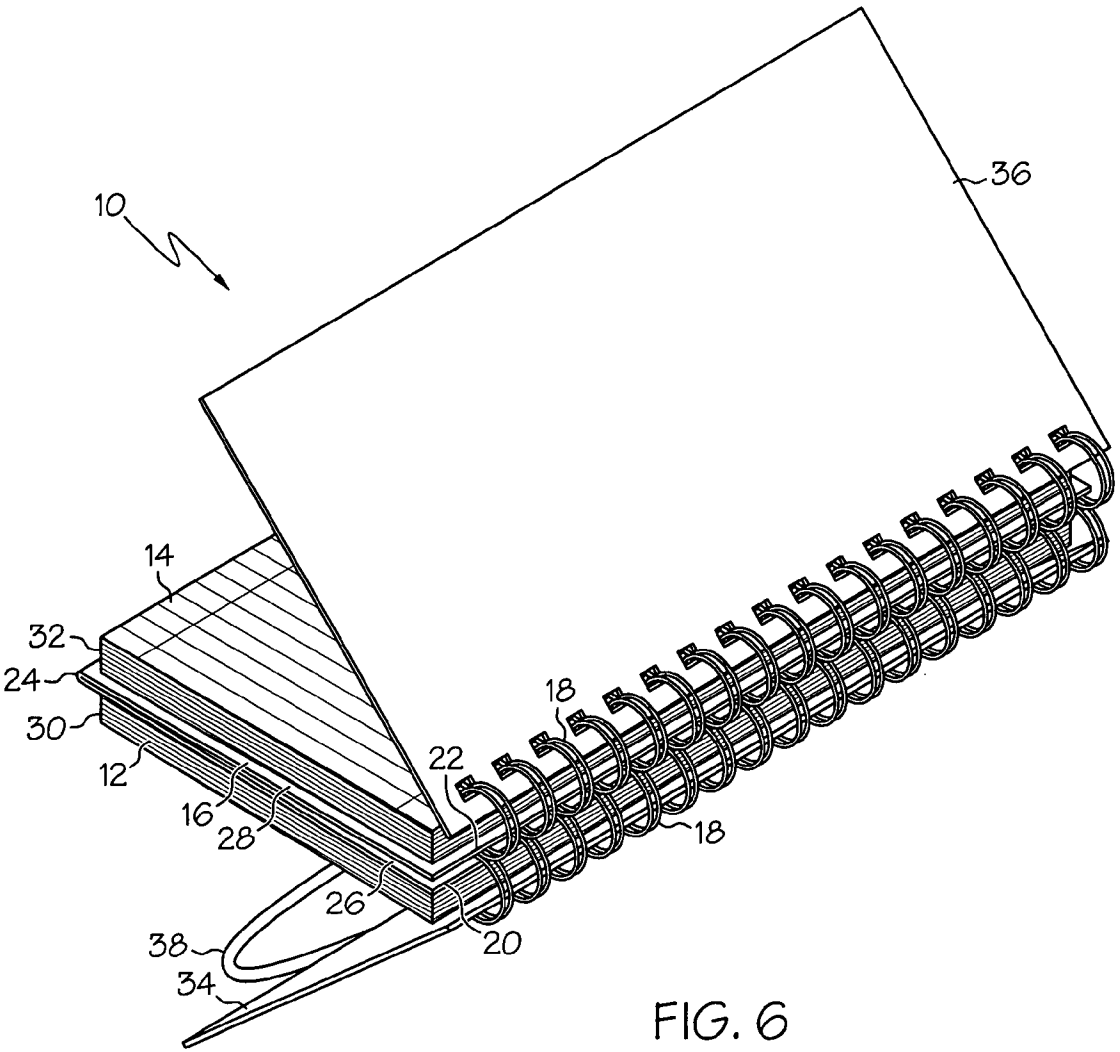
FIG. 6 is a front perspective view of the notebook of FIG. 5, with the front covers partially opened.
Figure 8:
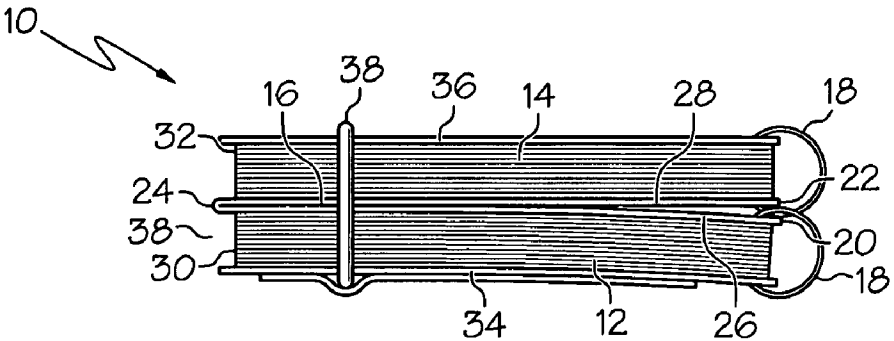
FIG. 8 is an end view of the notebook of FIG. 5, with the elastic retaining strap extending around the notebook.

The notebook 10 may be desired to be moved to the folded position to form a more compact arrangement (i.e., when it is desired to fit the notebook 10 into a pocket, purse, book bag, handbag or the like). When the notebook 10 is in its folded position, both of the sets of papers 12, 14 can still be individually accessed. For example, FIG. 6 illustrates both covers 34, 36 being partially opened to also allow access to both sets of papers 12, 14. In order to retain the notebook 10 in its folded position, the elastic cord or retaining device 38 may be stretched around the notebook 10, as shown in FIG. 8. Thus, the retaining device 38 ensures that the notebook 10 is retained in its folded position. When it is desired to return the notebook 10 to its flat position, the retaining device 38 is manipulated such that it is no longer located around the notebook 10, and the notebook 10/backing material 16 can be pivoted and returned to the flat position.

The binding mechanisms 18 may also be configured to cooperate with each other to retain the notebook 10 in its folded position. For example, with reference to FIG. 5A, the binding mechanism 18 may include a plurality of pairs 18*a* of twin-wire binding coils. Each pair 18*a* of coils have a gap 40 located therebetween The binding mechanisms 18 may be slightly offset from each other such that when the notebook 10 is in its folded position, a single binding coil of one binding mechanism 18 is received in the gap 40 between a pair 18*a* of binding coils of the other binding mechanism 18. The gap 40 of each pair 18*a* may be slightly smaller than the width of a single coil such that when the coil is received in the gap 40 the single coil is retained therein by the spring force of the pair 18*a* of binding coils. If desired, the binding mechanisms 18 may be configured such that each of the pairs 18*a* interleave with each other and couple together in this manner. Because each single coil may penetrate only slightly into the associated pair 18*a* of binding coils, the notebook 10 can still be relatively easily pivoted out of the folded position.

Figure 4A:
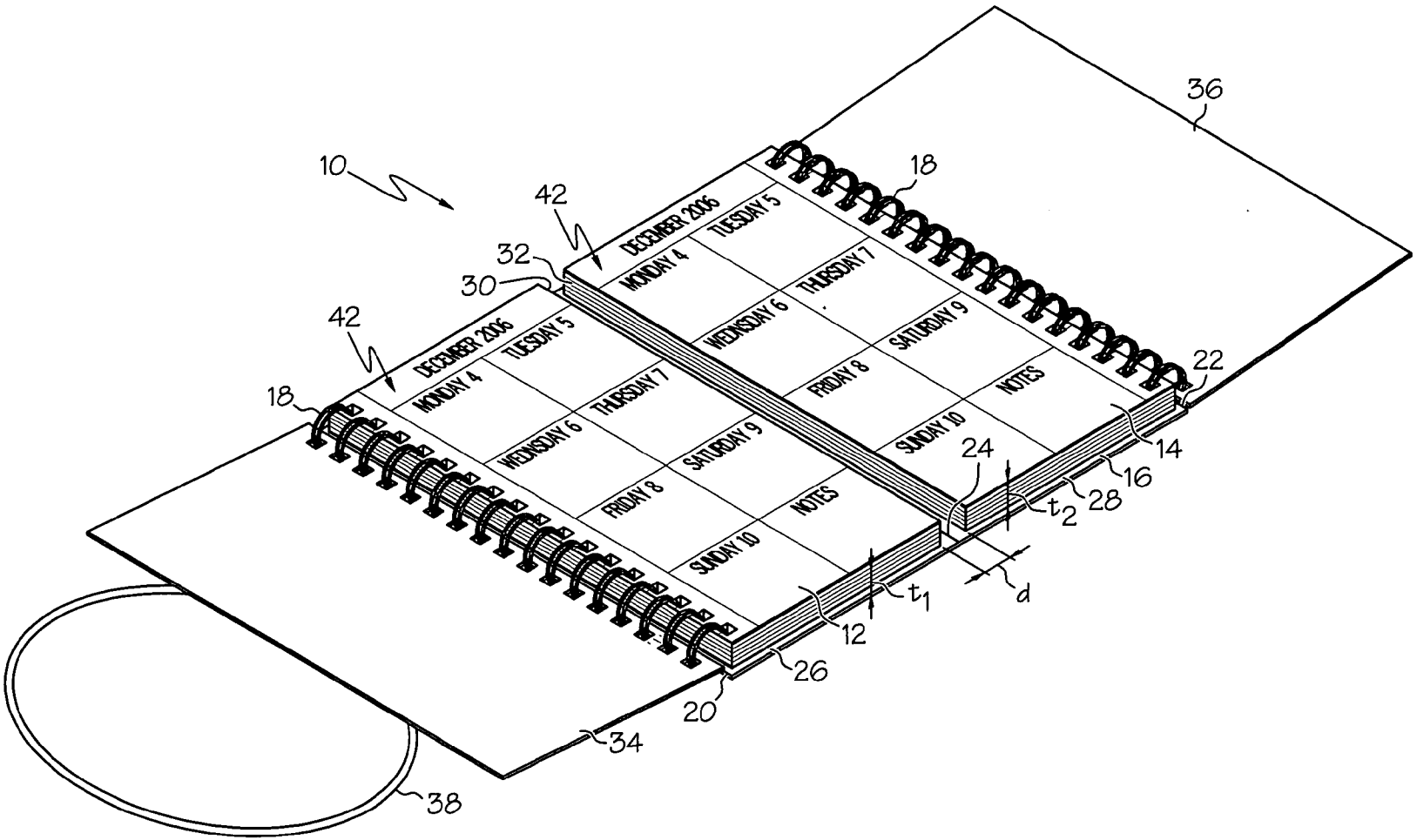
FIG. 4A is a front perspective view of another embodiment of the notebook of FIG. 1, with the front covers opened.
Figures 5, 5A:
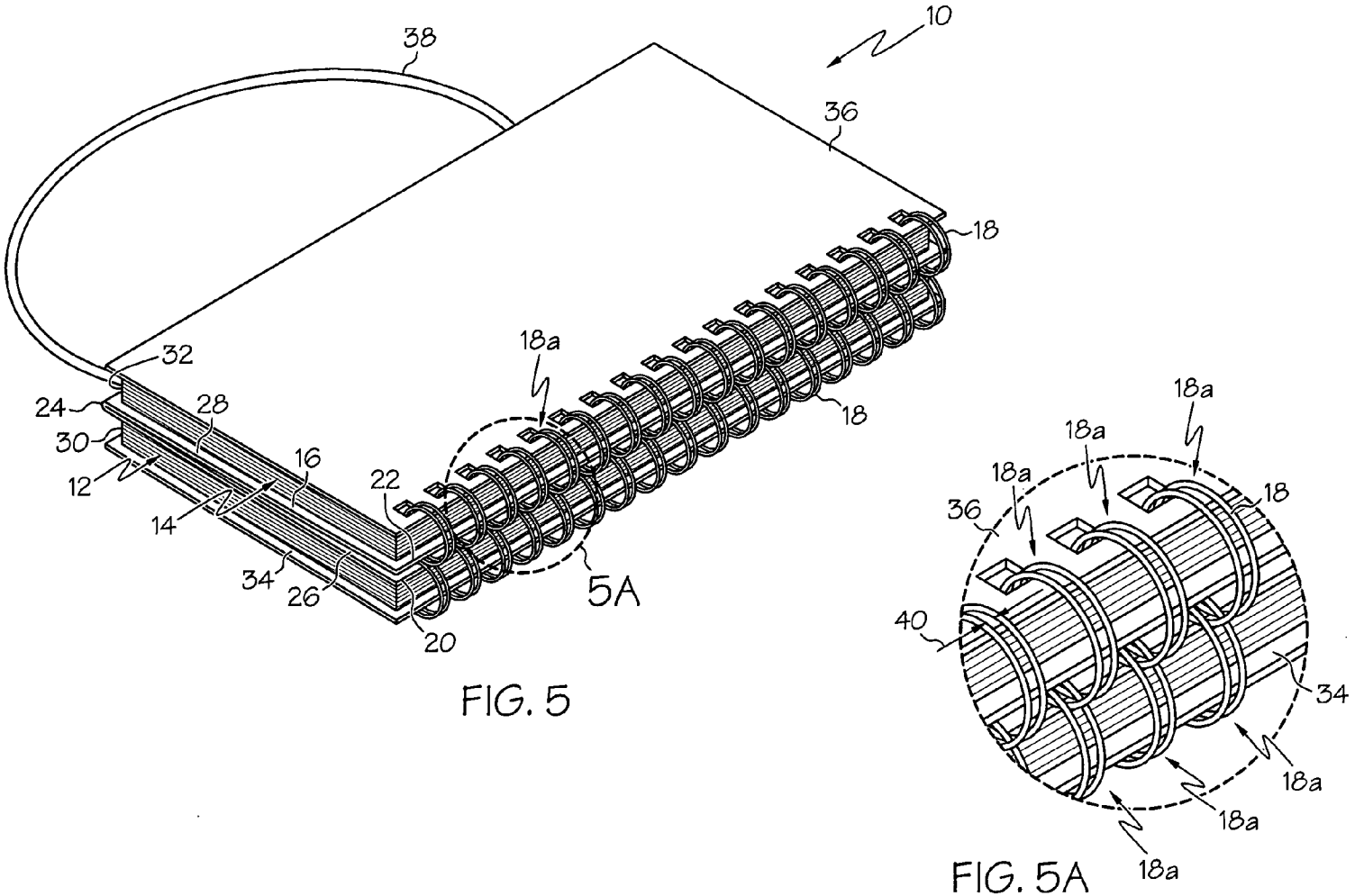
FIG. 5 is a front perspective view of the notebook of FIG. 1, moved to its folded position.
FIG. 5A is a detail view of the area designated in FIG. 5.

As shown in FIG. 4A each set of papers 12, 14 may include a calendar portion 42 thereon. The calendar portion 42 can be a daily, weekly, bi-weekly, monthly, bimonthly, or yearly calender portion, or other lengths of time. The sheets of paper in each set of papers 12, 14 may be chronologically arranged in the manner of a standard calendar.

In the embodiment shown in FIG. 4A the calendar portions 42 on both sets of papers 12, 14 are chronologically equivalent, or at least overlap chronologically. For example, in the embodiment shown in FIG. 4A both calendar portions 42 are for the time period of a week in December 2006. This arrangement allows a user to maintain two discrete calendar systems simultaneously. For example, the set of papers 12 may be utilized as a calender for the user's business affairs, and set of papers 14 may be utilized as a calendar for the user's personal affairs. In this manner, besides allowing two separate calendars to be utilized, the notebook 10 allows both calendar portions 42 to be viewed simultaneously such that both social and business appointments can be seen. However, it should be understood that various other calendar arrangement may be utilized, and the calendar portions 42 on both sets of papers 12, 14 need not necessarily mirror each other or overlap chronologically.

Accordingly, the notebook of the present invention allows the notebook 10 to be utilized in a side-by-side configuration, but also to be moved and retained in a compact, folded position. The small gap or distance d between the sets of papers 12, 14 ensures a compact, economical notebook. Because the distance d is relatively small, it may be difficult or impossible to fold the notebook 10 inwardly such that the backing material 16 forms the outer surface of the notebook 10. Instead, when in the folded position, the backing material 16 is preferably internally positioned.

Having described the invention in detail and by reference to the preferred embodiments, it will be apparent that modifications and variations thereof are possible without departing from the scope of the invention.

What is claimed is:

1. A dual notebook comprising:

a sheet of backing material;

a first set of papers bound to said backing material and having a thickness;

a second set of papers bound to said backing material and having a thickness;

a first binding mechanism binding said first set of papers to said backing material the first binding mechanism being comprised of a first plurality of twin-wire coils; and a second binding mechanism binding said second set of papers to said backing material, the second binding mechanism being comprised of a second plurality of twin-wire coils, wherein said backing material is configured to be folded into a folded position wherein said folded backing material is positioned between said first and second set of papers in a thickness direction of said notebook, and wherein said backing material is movable to a flat position wherein said backing material is generally flat, and wherein at least a first coil of the first binding mechanism is configured to be received between a corresponding pair of second coils of the second binding mechanism to retain said notebook in said folded position.

2. The notebook of claim 1 wherein said backing material forms a generally two-ply sheet of material when said backing material is in said folded position, with both plies being located between said first and second sets of papers in said thickness direction.

3. The notebook of claim 1 wherein said backing material includes a pair of opposed outer edges, and wherein said first set of papers is bound at or adjacent to one of said outer edges, and said second set of papers is bound at or adjacent to the other one of said outer edges.

4. The notebook of claim 3 wherein said backing material is generally rectangular when in said flat position.

5. The notebook of claim 1 wherein said backing material includes a folding guide line about which said backing material is foldable.

6. The notebook of claim 1 wherein said backing material has a width dimension extending generally perpendicular to a direction about which said backing material is configured to be folded, and wherein said first and second sets of paper have a combined width that is less than the width of said backing material.

7. The notebook of claim 1 wherein said first and second sets of papers each include an inner edge, wherein said inner edges are generally parallel and spaced apart by a distance less than the combined thickness of said first and second sets of papers.

8. The notebook of claim 1 wherein said first and second sets of papers can be individually accessed when said backing material is in said folded position.

9. The notebook of claim 1 wherein said backing material has a first portion supporting said first set of papers and a second portion supporting said second set of papers, wherein said first and second portions overlap and are oriented generally parallel and immediately adjacent to each other when said backing material is in said folded position.

10. The notebook of claim 1 further comprising a first cover bound to first set of paper and a second cover bound to said second set of papers, each cover having at least one of a thickness or stiffness greater than each paper of the associated set of papers.

11. The notebook of claim 1 further comprising a retaining device coupled to at least one of said backing material or said first or second set of papers, wherein said retaining device is configured to retain said backing material in said folded position.

12. The notebook of claim 11 wherein said retaining device includes a strip of elastic material.

13. The notebook of claim 1 wherein said first set of papers has a calendar portion printed thereon and said second set of papers has a calendar portion printed thereon, and wherein said first and second calendar portions overlap chronologically.

14. The notebook of claim 1 wherein the first coil of the first binding mechanism is configured to be retained by spring force between the corresponding pair of second coils.

15. The notebook of claim 1 wherein the first plurality of twin-wire coils respectively interleave with the second plurality of twin-wire coils.

16. The notebook of claim 1 wherein said first and second sets of papers each have a thickness, and wherein when said backing material is in said flat position said first and second sets of papers are spaced apart by a distance less than the combined thickness of said first and second sets of papers.

17. A method for using a notebook comprising:

providing a notebook having a sheet of backing material, a first set of papers bound to said backing material, a second set of papers bound to said backing material and spaced apart from said first set of papers, a first binding mechanism binding said first set of papers to said backing material, and a second binding mechanism binding said second set of papers to said backing material, the first binding mechanism being comprised of a first plurality of twin-wire coils, and the second binding mechanism being comprised of a second plurality of twin-wire coils; and forming said backing material into a folded position wherein said folded backing material is positioned between said first and second set of papers in a thickness direction of said notebook, at least a first coil of the first binding mechanism being configured to be received between a corresponding pair of second coils of the second binding mechanism to retain said notebook in said folded position.

18. The method of claim 17 wherein said first and second sets of papers each have a thickness, and wherein when said backing material is in said flat position said first and second sets of papers are spaced apart by a distance less than the combined thickness of said first and second sets of papers.

19. The method of claim 17 wherein said backing material forms a generally two-ply sheet of material when said backing material is in said folded position, with both plies being located between said first and second sets of papers in said thickness direction.

* * * * *